United States Patent [19]

Sato et al.

[11] 4,414,897

[45] Nov. 15, 1983

[54] INKING MECHANISM IN A ROTARY PRESS

[75] Inventors: Masayoshi Sato, Kawasaki; Kunio Suzuki, Yokohama, both of Japan

[73] Assignee: Kabushiki Kaisha Tokyo Kikai Seisakusho, Tokyo, Japan

[21] Appl. No.: 458,948

[22] Filed: Jan. 18, 1983

Related U.S. Application Data

[63] Continuation-in-part of Ser. No. 193,088, Oct. 2, 1980, abandoned.

[30] Foreign Application Priority Data

Jun. 6, 1980 [JP] Japan ..... 55-076501

[51] Int. Cl.[3] ..... B41F 31/00

[52] U.S. Cl. ..... 101/216; 101/350; 101/363

[58] Field of Search ..... 101/154, 157, 160, 166, 101/169, 206, 207, 208, 216, 219, 330, 350, 351, 101/363; 118/261, 262

[56] References Cited

U.S. PATENT DOCUMENTS

| | | | |
|---|---|---|---|
| 2,270,272 | 1/1942 | Davidson | 101/217 X |
| 2,278,138 | 3/1942 | Paardecamp | 101/366 X |
| 2,703,525 | 3/1955 | Stempel | 101/350 X |
| 3,070,066 | 12/1962 | Faeber | 118/261 X |
| 3,309,992 | 3/1967 | Motter | 101/169 |
| 3,630,146 | 2/1970 | Shields | 101/351 |
| 3,738,265 | 6/1973 | Saueressig | 101/351 X |
| 4,057,012 | 11/1977 | Heidemann | 101/219 X |
| 4,240,347 | 12/1980 | Hazelton et al. | 101/157 X |

FOREIGN PATENT DOCUMENTS

| | | | |
|---|---|---|---|
| 612178 | 11/1948 | United Kingdom | 101/157 |

*Primary Examiner*—Edgar S. Burr
*Assistant Examiner*—Charles A. Pearson

[57] ABSTRACT

In an inking mechanism in a rotary press a doctor blade is provided to prevent the mixing into the ink of bubbles which cause the scattering of an ink mist upon bursting of the bubbles. The doctor blade can swing along the circumferential surface of eccentric sleeves supporting both ends of a fountain roll. A free end portion of the doctor blade contacts with a position just progressed in the rotative direction on that portion of the circumferential surface of a mesh roll to which ink is transferred from the fountain roll. A scraped ink returning plate is provided close to and along the circumferential surface of the fountain roll providing a streamline flow of the scraped ink without turbulent flow. The free end portion of the doctor blade can be displaced for cleaning and replacement.

1 Claim, 8 Drawing Figures

INKING MECHANISM IN A ROTARY PRESS

This is a continuation-in-part of application Ser. No. 193,088 filed Oct. 2, 1980 now abandoned.

BACKGROUND OF THE INVENTION

1. Field of the Invention

The present invention relates to an inking mechanism in a rotary press, more particularly, an ink scraper device for a mesh roll in a rotary press wherein a two-roll system for flexographic printing, i.e. a system for transferring the ink in an ink pan to an Anilox roll (having another name of mesh roll or screened roll) via a fountain roll is utilized, comprising a doctor blade adapted to be brought into contact at a free end portion thereof with the circumferential surface of the mesh roll to scrape off excess ink therefrom.

2. Description of the Prior Art

It has recently been demonstrated that a printing mechanism for a newspaper rotary press can be simplified, miniaturized and reduced in weight and manufacturing cost by making use of the advantage of flexographic printing technique wherein a single mesh roll is used to omit using a plurality of ink cylinders.

It is necessary that a newspaper rotary press be rotated at a very high speed in order to inform people of daily events early. When, for example, 70,000 copies of newspaper are printed per hour, a web runs through each part of a printing mechanism at 35–40 km/hr.

A fountain roll for use in drawing ink from an ink pan is operated properly even when the rotational speed is reduced to 1/20 of the peripheral speed of a plate cylinder, i.e. not more than around 2 km/hr. Therefore, the scattering of ink mist can substantially be prevented. Namely, rotating a fountain roll at a low speed causes no trouble.

On the other hand, it is necessary that the mesh roll, to which ink is transferred from the fountain roll, be adapted to constantly feed ink film onto the plate cylinder. In other words, it is necessary that the mesh roll be rotated at the same peripheral speed as the plate cylinder. When the feed rate of ink onto the circumferential surface of the mesh roll is even a little too high, ink mist is scattered by a great centrifugal force.

The scattering of ink mist at the circumferential surface of the mesh roll may be surely prevented if any excess ink is scraped off therefrom the moment the ink is transferred from the fountain roll onto the circumferential surface of the mesh roll.

In order to attain the removal of excess ink from the circumferential surface of the mesh roll, it is necessary to dispose a doctor blade such that a free end portion of the doctor blade is projected toward the contact point of the fountain roll and mesh roll so as to be brought into contact, in opposition to the rotational direction of the mesh roll (at a reverse angle), with that portion of the circumferential surface of the mesh roll which is immediately after the position where ink is transferred.

However, when the doctor blade is stationarily extended in an extremely narrow gap between the two rolls referred to above, the inspection, cleaning and replacement of the blade cannot be carried out speedily and sufficiently with ease. Under such circumstances, a prompt printing of newspapers cannot possibly be attained. In fact, the inspection, cleaning and replacement of a doctor blade have to be carried out in quick and accurate steps as in the case of the replacement of a tire of a/pitted-in racing car. This makes it necessary to develop a displacement means which permits displacing at a large angle the doctor blade from such a narrow space as mentioned above to a place where it can be easily inspected, cleaned and replaced.

However, a doctor blade which is capable of being displaced at a large angle may not be practically useful unless the excess ink, which has been scraped off by the doctor blade, always returns by way of the shortest distance into the ink pan along the circumferential surface of the fountain roll without causing scattering of ink mist.

If the ink is a viscous liquid and has turbulent flow it will contain many air bubbles which have great difficulty leaving the ink.

The bubbles are transferred to the mesh roll via the fountain roll from the ink pan, and the bubbles will enter the reticulate grooves of the mesh roll which prevents the ink attaching in the reticulate grooves of the mesh roll. Consequently, smooth printing is prevented due to the bubbles and the quality of printing drops.

On the other hand, since the bubbles mixed in the ink are broken at the closing position between the rolls contacting each other, the bubble bursts cause the scattering of ink mist and makes the printing paper dirty.

SUMMARY OF THE INVENTION

An object of the present invention is to provide an ink scraper device for an anilox roll in rotary presses, which permits:

(1) removing to a great extent the ink mist occurring on the mesh roll even when the printer is rotated at a high speed, (2) conducting inspection, cleaning and replacement of a doctor blade speedily and accurately with ease, (3) returning the excess ink which has been scraped off by the doctor blade by the shortest route to an ink pan properly at all times, in a state such that any air bubbles do not mix in the ink, and (4) serving as an important technical base for the development of a miniaturized, light-weight, simply constructed, low-price, high-speed newspaper rotary press utilizing a flexographic printing technique.

A summary of the concept of the present invention resides in the following.

In an inking mechanism of high speed rotary press a fountain roll and a mesh roll are arranged at very close positions to each other. While the fountain roll can be rotated at a low speed of not more than 1/20 of that of a plate cylinder, the mesh roll must be rotated a high speed equal to that of the plate cylinder.

Thus, in order to prevent the mixing into the ink of bubbles which cause the scattering of ink mist when the bubbles burst;

(a) a doctor blade is provided so as to swing along the circumferential surface of eccentric sleeves supporting both ends of the fountain roll, (b) a free end portion of the doctor blade is provided so as to contact with a positioned, just progressed in the rotative direction on that portion of the circumferential surface of a mesh roll to which ink is transferred from the fountain roll, (c) a scraped ink returning plate is provided close to and along the circumferential surface of the fountain roll providing a streamline flow of the scraped ink without turbulent flow which causes the bubbles in the ink, and (d) means for displacing the free end portion of the doctor blade is provided for cleaning and replacing it.

The above and other objects as well as advantageous features of the invention will become apparent from the following description of the preferred embodiment taken in conjunction with the accompanying drawings.

BRIEF DESCRIPTION OF THE DRAWINGS

The drawings attached hereto shows an embodiment of an ink scraper device for a mesh roll in a rotary press, wherein.

DETAILED DESCRIPTION OF THE INVENTION

A preferred embodiment of the present invention will be described in detail with reference to the accompanying drawings.

Figure 1:
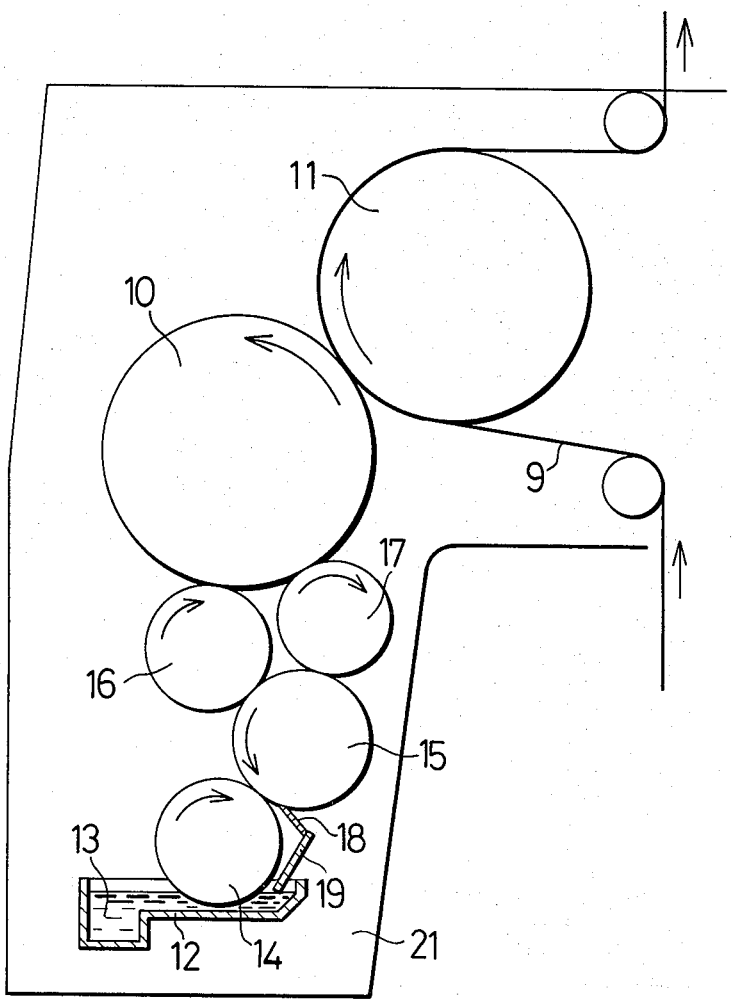
FIG. 1 is a schematic diagram of a rotary press employing an ink scraper device according to the present invention.
Figure 2:
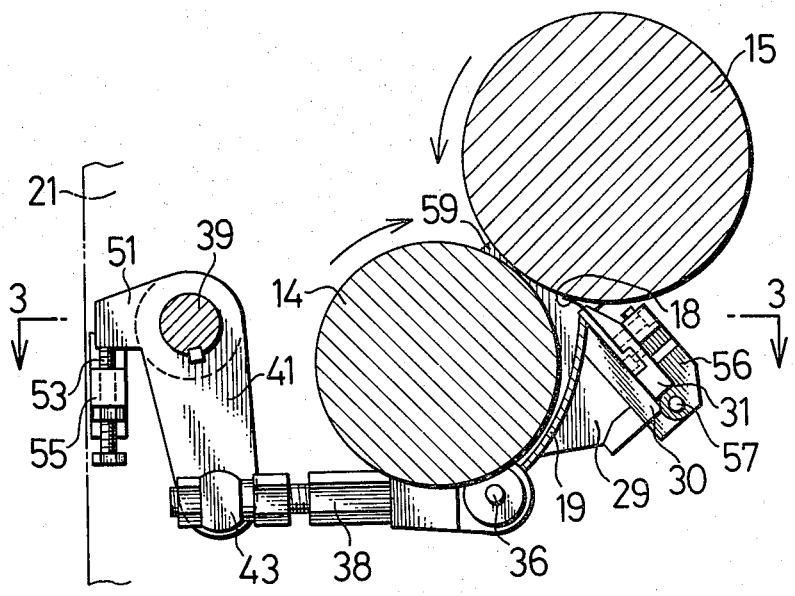
FIG. 2 is a longitudinal sectional view taken along the line 2—2 in FIG. 3, illustrating a principal portion of the embodiment shown in FIG. 1.
Figure 4:
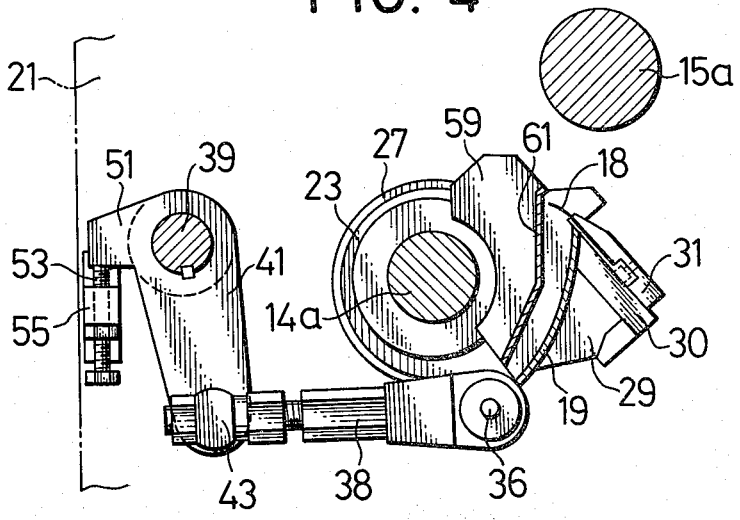
FIG. 4 is a longitudinal sectional view taken along the line 4—4 in FIG. 3.

FIG. 1 is a schematic diagram of a rotary press utilizing the above-mentioned two-roll system for flexographic printing, to which an ink scraper device according to the present invention is applied. A web 9 is introduced between a plate cylinder 10 and an impression cylinder 11 to be printed at one side thereof. The ink 13 in an ink pan 12 is drawn by a fountain roll 14 and transferred onto a mesh roll 15 so as to be supplied to the plate cylinder 10 via two form rolls 16, 17.

The fountain roll 14 is made of a metal and immersed at its lower surface in the ink 13 in the ink pan 12. The fountain roll 14 is rotated in a clockwise direction in the drawing at a low peripheral speed of not more than 1/20 of the peripheral speed of the plate cylinder 10 to draw the ink 13 so that the scattering of ink mist does not substantially occur.

Mesh roll 15 is provided diagonally above and on the right side of the fountain roll 14 such that these rolls are very close to each other. The circumferential surface of the mesh roll is made of special steel and has reticulate grooves, and this surface is plated with hard chromium to have an improved wear resistance. The size of meshes of the reticulate grooves is as small as 250 meshes.

Since the peripheral speed of the mesh roll 15 is equal to that of the plate cylinder 10, a large centrifugal force is generated so that ink mist is scattered. Therefore, the feed rate of ink onto the surface of the anilox roll is limited to as low a level as possible, and excess ink is scraped off by a doctor blade 18. Accordingly, the ink supplied from the mesh roll 15 to form rolls 16, 17 is limited to such fraction of ink that remains in the reticulate grooves after excess ink has been scraped off by the doctor blade 18.

According to the present invention, the free end portion of the doctor blade 18 is brought into contact with that portion of the circumferential surface of the mesh roll 15 which has just received ink film (a means for regulating the thickness of this film will be described later) from the fountain roll 14, in order to thoroughly remove ink mist occurring due to the high-speed rotation of the mesh roll 15. The excess ink scraped off by the blade 18 is returned by an ink returning plate 19 along the circumferential surface of the fountain roll 14 to the ink pan 12 or along the shortest way between the lower surface of the mesh roll 15 and the ink pan. The doctor blade 18 having such an important role requires to be inspected, cleaned and replaced with ease. This is specially important. Consequently, it is necessary that the doctor blade be displaced at a large angle.

The construction of a principal portion of the present invention which satifies the above three requirements will be described with reference to FIGS. 2–8.

In view of the necessity that excess ink scraped off from the mesh roll is returned to the ink pan 12 along the shortest way between the mesh roll and ink pan, which shortest way has a curved part along the surface of the fountain roll 14 and that the free end portion of the doctor blade 18 is brought into contact with and separated from the circumferential surface of the mesh roll 15, the doctor blade is disposed such that the center of swinging of the doctor blade is on the fountain roll 14.

Since the fountain roll 14 is made of a metal as the mesh roll 15, it is necessary that a means for regulating the thickness of ink film, i.e. the width of a gap between the fountain roll and mesh roll be provided. A means for regulating the thickness of ink film employed in the present invention consists of a pair of eccentric sleeves 22, 23 provided between shafts 14*a* at both ends of the fountain roll 14 and right and left frames 20,21, and a sleeve revolving mechanism (not shown). The sleeve revolving mechanism is operated to displace the fountain roll 14 toward and away from the mesh roll 15 to a small extent. Consequently, the doctor blade 18 swings along the circumferential surfaces of the eccentric sleeves 22, 23 supporting both ends of the fountain roll 14.

In order to swing the doctor blade 18 in the above-mentioned manner, rings 26, 27 are loosely fitted in grooves 24, 25 provided in the circumferential surfaces of the eccentric sleeves 22, 23. Arms 28, 29 are projected from one side of the rings 26, 27, and a base 30 is bridged over the end portions of the arms 28, 29. A blade holder 31 is secured to the base 30 with thumbscrews 32, 32*a* . . . , and the doctor blade 18 is supported on the holder 31 such that the blade 18 is projected toward the circumferential surface of the mesh roll 15. Accordingly, the free end portion of the blade 18 comes into contact with the circumferential surface of the mesh roll 15 in a direction opposite to the direction in which the mesh roll 15 is rotated. The contact pressure of the blade 18 is extremely small. In fact, a contact pressure of 3–6 g/cm$^2$ is enough to produce a sufficient ink scraping effect so that the circumferential surface of the mesh roll is rarely hurt.

A mechanism for swinging the doctor blade 18 forwardly and backwardly will be described.

Second arms 33, 34 (refer to FIGS. 3 and 6) are projected from the rings 26, 27, respectively, and links 37, 38 are pivotally connected at one end each thereof to the free ends of the arms 33, 34 via pins 35, 36.

A cross shaft 39 is rotatably provided between the side frames 20, 21, and bell crank levers 40, 41 are secured in the same phase to two portions of the shaft 39.

The levers 40, 41 are pivotally connected at one end portion of each thereof to the other end portions of the link 37, 38 by pins 42, 43.

The cross shaft 39 is projected at one end portion thereof beyond the outer surface of the side frame 20, and a shaft rotating arm 44 is secured to the projected end portion of the shaft 39. A plunger 46 is pivotally connected at an end portion thereof to the other end portion of the arm 44 via a pin 45. The plunger 46 is actuated by an air cylinder 47, which is pivotally connected at its base end via a pin 49 to a bracket 48 fastened to the side surface of the side frame 20.

A means for regulating the contact pressure or contact depth of the doctor blade 18 with respect to the mesh roll 15 can be provided in the above-mentioned air pressure transmission system. For example, adjust screws 52, 53 are applied at their front end surface to the lower surfaces of minor levers 50, 51 integrally formed with the bell crank levers 40, 41 extended from the cross shaft 39, to be engaged with female screws in brackets 54, 55 provided on the frames 20, 21. Since the retraction length of the plunger 46 is restricted by adjusting the above-mentioned screws, the contact pressure of the blade 18 can be regulated.

A means for backwardly pivoting the doctor blade 18 can be displaced backwardly at approximately 90° about a pin 57 as a fulcrum owing to a hinge 56 fixed to the rear end surface of the base 30 and the upper surface of the blade holder 31. (Refer to FIG. 8.) In order to backwardly displace the blade 18, it is necessary that the thumbscrews 32, 32*a* . . . be removed first to separate the blade holder 31 from the base 30.

Ink mist shield members 58, 59 are secured to both side surfaces of the blade holder 31 such as to be extended toward the shaft 14*a* of the fountain roll 14 and prevent ink mist from being scattered sideways.

At the inner side of the shield members 58, 59, auxiliary plates 60, 61 are provided, which are substantially parallel to the scraped ink returning plate 19 and which are substantially on the extension line of a part of the curved circumferential surface of the fountain roll 14, to thereby prevent to as great an extent as possible the scraped ink from escaping and allow excess ink to be returned securely to the ink pan.

The operation of the present invention will be described.

When the air cylinder 47 is actuated to retract the plunger 46, the displacement of the plunger is transmitted to the rings 26, 27 on the eccentric sleeves 22, 23 via the arm 44, cross shaft 39, bell crank levers 40, 41, links 37, 38, and second arms 33, 34 so that the rings 26, 27 are oscillated counterclockwise in the drawings at once. As a result, the blade holder 31 integrally formed with the base 30 on the arms 28, 29 is also swung counterclockwise so that the free end portion of the doctor blade 18 is forwardly projected to come into contact, in opposition to the direction of rotation of the mesh roll 15, with that portion of the circumferential surface of the mesh roll 15 which has just received ink from the fountain roll 14 and which is in the deepest section of a narrow space defined by the rolls 14, 15.

The contact pressure or contact depth of the blade 18 is regulated by controlling the screws 52, 53 applied to the lower surfaces of the minor levers 50, 51.

In order to inspect, clean or replace the doctor blade 18, it is necessary that the blade 18 be withdrawn from the deepest section of the above-mentioned narrow space to an open space where the blade can be easily subjected to such treatment.

Figure 3:
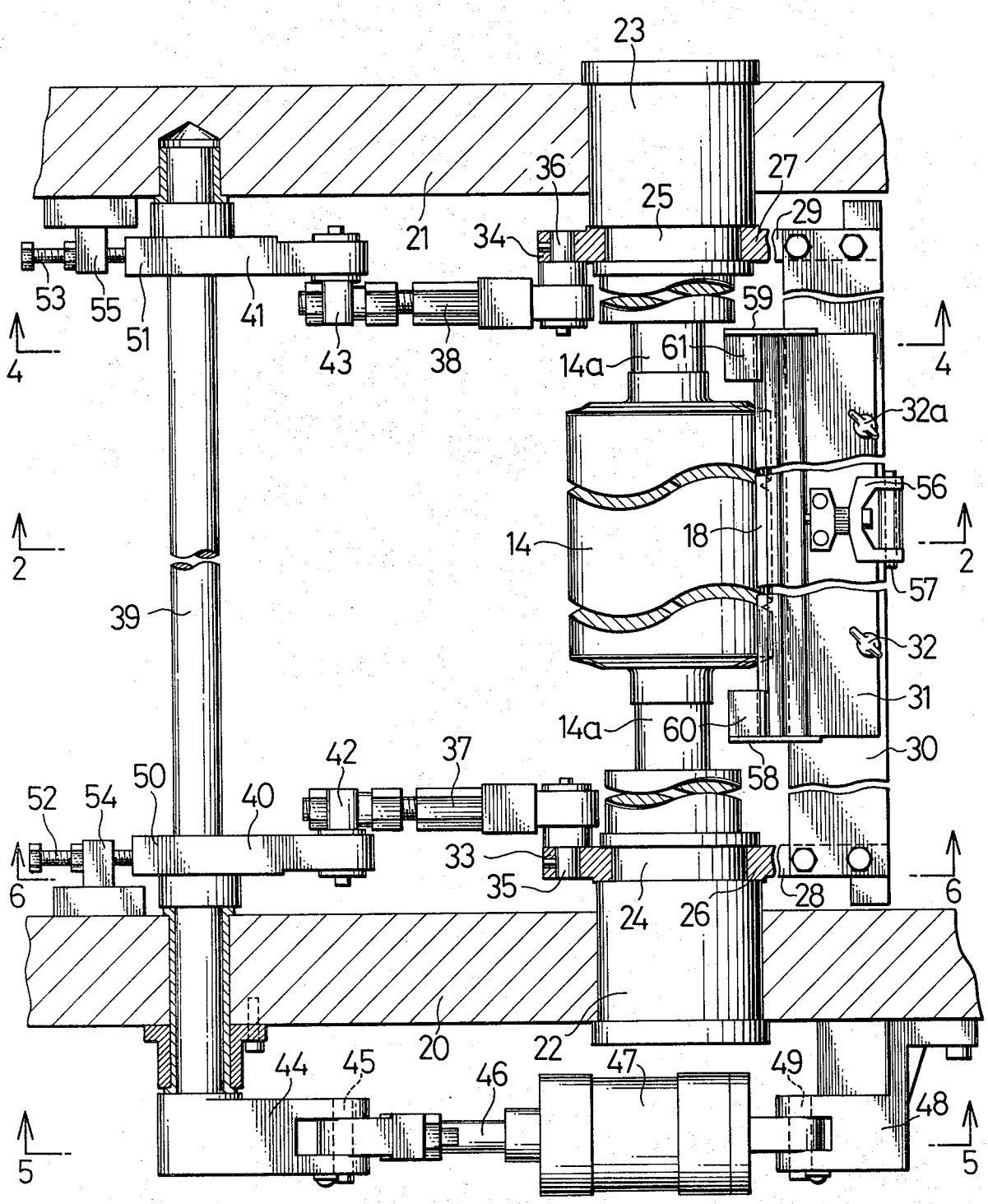
FIG. 3 is a plan view taken along the line 3—3 in FIG. 2.
Figure 5:
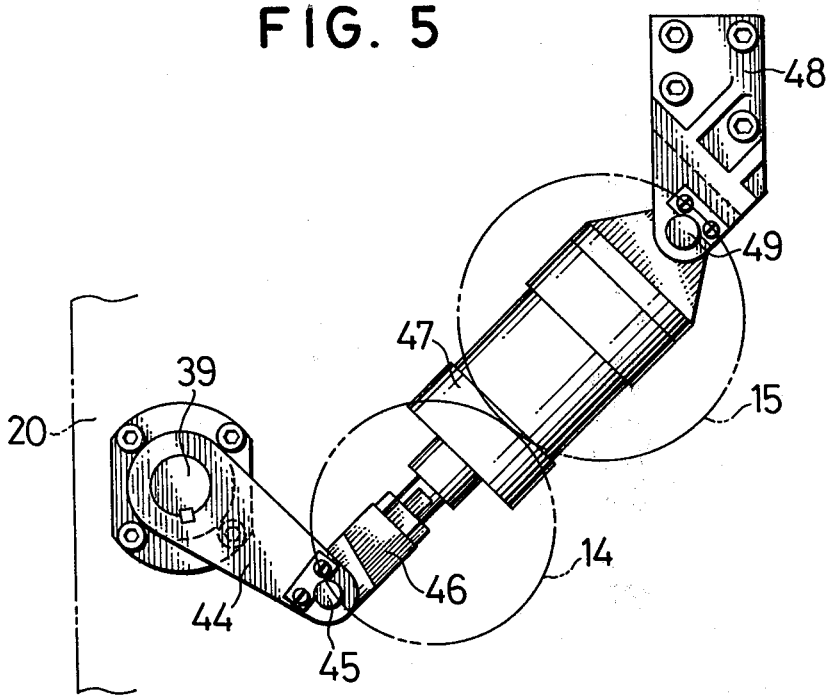
FIG. 5 is a longitudinal sectional view taken along the line 5—5 in FIG. 3.
Figure 6:
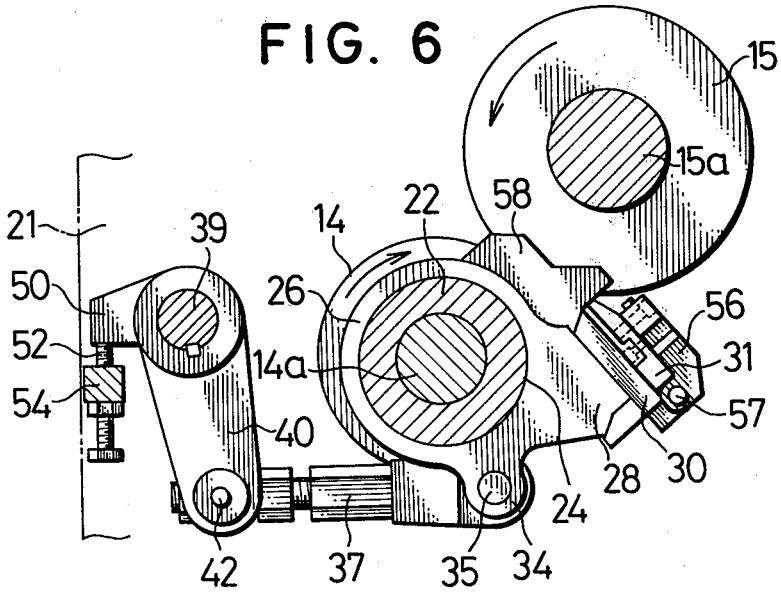
FIG. 6 is a longitudinal sectional view taken along the line 6—6 in FIG. 3.
Figure 7:
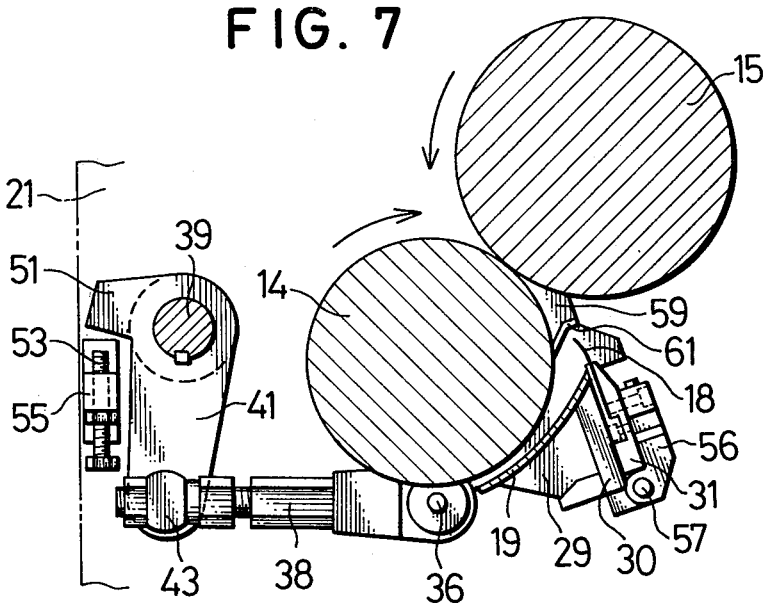
FIGS. 7 and 8 are longitudinal sectional views taken along the line 2—2 in FIG. 3 in the same manner as FIG. 2, illustrating the operation of the embodiment in comparison with FIG. 2.
Figure 8:
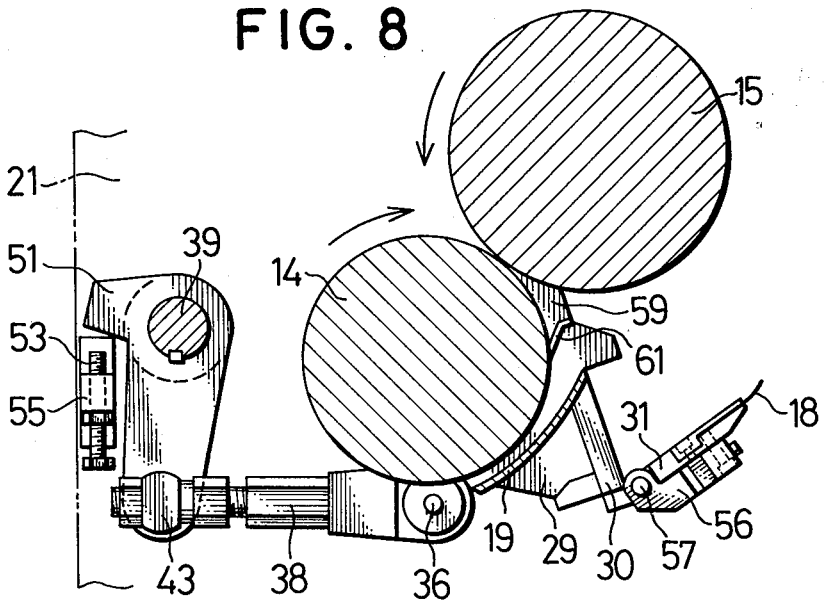

When the air cylinder 47 is actuated to extend the plunger 46, the displacement of the plunger 46 is transmitted to the rings 26, 27 on the eccentric sleeves 22, 23 via the arm 44, cross shaft 39, bell crank levers 40, 41, links 37, 38, and second arms 33, 34 so that the rings 26, 27 are oscillated clockwise in the drawings at once. As a result, the blade holder 31 integrally formed with the base 30 on the arms 28, 29 is also swung clockwise so that the free end portion of the doctor blade 18 is backwardly swung from a first position shown in FIG. 2 to a second position shown in FIG. 7. When the thumbscrews 32, 32*a* . . . shown in FIG. 3 are then removed, the blade holder 31 and base 30 are separated from each other. When the blade holder 31 is pulled backwardly by hand, the holder 31 is displaced in the same direction about the pin 57 at approximately 90°. (Refer to FIG. 8).

Since the oscillatory displacement of the doctor blade 18 progresses on the basis of the eccentric sleeves 22, 23, the doctor blade 18 can be pressed against that portion of the circumferential surface of the mesh roll 15 which is in the deepest section of the narrow space between the fountain roll 14 and mesh roll 15, irrespective of the degree of displacement of the fountain roll 14. The scraped ink returning plate 19 which is swung with the base 30 also permits securely returning ink to the ink pan 12 along the shortest way between the mesh roll 15 and ink pan 12 irrespective of the degree of displacement of the fountain roll 14.

Owing to such a skillful constructional arrangement of the present invention, excess ink can be scraped off completely by the doctor blade 18 immediately after the ink has been transferred to the mesh roll 15, from that portion of the circumferential surface of the mesh roll which has just received ink from the fountain roll, the excess ink thus scraped off being securely returned to the ink pan 12. Accordingly, the present invention permits completely eliminating the ink mist scattering trouble from a newspaper printer which requires to be rotated at a high speed. The above-described technical effect of the present invention constitutes a technical base in a newspaper rotary press employing a flexographic printing technique, and allows the printing mechanism to be simplified and reduced in dimensions, weight and manufacturing cost.

Moreover, when the doctor blade 18 is inspected, cleaned or replaced, it can be withdrawn speedily and smoothly from the deepest section of the narrow space between the mesh roll and fountain roll to a wide space which is in an excellent working condition, by a combination of a plunger retraction operation of the air cylinder 47 and a backward pivoting of the blade holder 31. Therefore, an ink scraper device according to the present invention can be excellently applied to a newspaper printer which requires a high-speed maintenance work for the printing mechanism and which has parts rapidly worn out.

The present invention is not, of course, limited to the above-described embodiment; it may be modified in various ways within the scope of the appended claims.

We claim:

1. An inking mechanism in a rotary press comprising an ink pan, a fountain roll having a circumferential surface for drawing ink from the pan and transferring it to a circumferential surface of a mesh roll, a plate cylinder to which the ink is supplied from the mesh roll via a pair of form rolls, said mesh roll rotating at a high speed equal to that of the plate cylinder, a doctor blade which is provided on a base being traversed on arms swinging along the circumferential surface of eccentric sleeves supporting both ends of said fountain roll, a scraped ink returning plate provided close to and along the circumferential surface of the fountain roll which is swingable with said base, means for swinging a free end portion of the doctor blade between a contact position in which said free end portion of the doctor blade makes contact with a position just progressed in the rotative direction on that portion of the circumferential surface of the mesh roll to which ink is transferred from the fountain roll and a non-contact position in which said free end portion of the doctor blade is removed from the circumferential surface of the mesh roll along the circumferential surface of the eccentric sleeves, and means for pivoting and doctor blade at said non-contact position in a direction away from both of the circumferential surfaces of the mesh roll and the fountain roll.

* * * * *